US006321735B2

(12) United States Patent
Grieve et al.

(10) Patent No.: US 6,321,735 B2
(45) **Date of Patent: *Nov. 27, 2001**

(54) FUEL CONTROL SYSTEM WITH PURGE GAS MODELING AND INTEGRATION

(75) Inventors: Malcolm James Grieve, Fairport, NY (US); Edward George Himes, Novi; Ningsheng Qiao, Troy, both of MI (US)

(73) Assignee: Delphi Technologies, Inc., Troy, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/264,524

(22) Filed: Mar. 8, 1999

(51) Int. Cl.[7] ..... F02D 41/14

(52) U.S. Cl. ..... 123/674; 123/698; 123/520; 701/104

(58) Field of Search ..... 123/674, 698, 123/520; 701/103, 104

(56) References Cited

U.S. PATENT DOCUMENTS

| | | | | |
|---|---|---|---|---|
| 5,520,160 | * | 5/1996 | Aota et al. | 123/698 |
| 5,626,122 | * | 5/1997 | Azuma | 123/698 |
| 5,778,867 | * | 7/1998 | Osanai | 123/698 |
| 5,944,003 | * | 8/1999 | Osanai | 123/698 |
| 6,039,032 | * | 3/2000 | Morikawa et al. | 123/698 |

OTHER PUBLICATIONS

Sutan, Wind, Matthews; Closed Loop Canister Purge Control System, Feb. 23–26, 1998; SAE International Congress and Exposition, Detroit , MI.

* cited by examiner

*Primary Examiner*—Erick Solis
(74) *Attorney, Agent, or Firm*—Vincent A. Cichosz

(57) ABSTRACT

A fuel control system that estimates the fuel quantity received from purging of an evaporative emission control system and then accounts for the purge fuel in determining the amount of fuel to be injected into a cylinder of an internal combustion engine. Purge fuel quantity is represented by a purge equivalence ratio which is computed based upon an estimate of the hydrocarbon concentration in the purge gas. The hydrocarbon concentration is adaptively learned using an iterative routine that updates the estimate based on the integrated error between the actual and desired air/fuel ratios. Wall wetting and closed loop corrections are applied only to the non-purge fuel portion of the total fuel delivered to the engine cylinder. The closed loop control includes a block learn memory that provides a correction to the factory fuel calibration. The hydrocarbon concentration is updated using the integrated error during purging, whereas the block learn memory is updated using the integrated error during periods when no purging is occurs. The evaporative emission control system includes a solenoid-operated purge valve that is controlled in a manner that provides improved fuel control during transient conditions. The solenoid duty cycle is controlled using a purge factor that operates to reduce the duty cycle when the intake airflow rate drops significantly.

21 Claims, 8 Drawing Sheets

| | Purge Port 62 | | | | | Intake Port 66 |
|---|---|---|---|---|---|---|
| Event 1 | 0.2 | 0 | 0 | 0 | 0 | 0 |
| Event 2 | 0.2 | 0.2 | 0 | 0 | 0 | 0 |
| Event 3 | 0.2 | 0.2 | 0.2 | 0 | 0 | 0 |
| Filter | 0.2 | 0.2 | 0.19 | 0.01 | 0 | 0 |
| Event 4 | 0.2 | 0.2 | 0.2 | 0.19 | 0.01 | 0 |
| Event 5 | 0.2 | 0.2 | 0.2 | 0.2 | 0.19 | 0.01 |

*Fig. 7*

FUEL CONTROL SYSTEM WITH PURGE GAS MODELING AND INTEGRATION

TECHNICAL FIELD

This invention relates generally to fuel injection systems and evaporative emissions control systems used in automobile fuel systems to reduce evaporative and exhaust emissions and, in particular, to such systems in which the fuel calculations performed by the fuel injection system account for the fuel vapor added to the intake air during purging.

BACKGROUND OF THE INVENTION

The automotive industry has had notable success in the reduction of regulated gaseous emissions from the use of hydrocarbon fuels in mass produced automobiles. For gasoline spark ignited engines, the gaseous emissions fall into two categories:

(1) evaporative emissions—which relate to unburned fuel vapors escaping from the vehicle's fuel tank, and (2) tailpipe emissions—which relate to emissions from the exhaust of the engine and include unburned and partially burned fuel, carbon monoxide, and oxides of nitrogen.

In the mid 1970s, catalytic converters and closed loop fuel control was adopted almost universally in the United States and progressively in other countries. As stricter emission control requirements were written into law, microprocessor-controlled fuel injection eventually became widespread, allowing for more elaborate and sophisticated control systems and fuel control strategies.

Early automotive control systems often used emulations of the mechanical controls that had been replaced by electronically-actuated devices. Simple physical and empirical strategies with primarily tabular calibrations were used in order to be compatible with the limited microprocessor capacity on-board the vehicle. Current state-of-the-art low emission systems utilize more advanced controls strategies that include mathematics and physics-based models of the complex chemical, thermodynamic, mechanical, and electrical processes that exist in the automobile. This modeling and control strategy is implemented using software which provides designers with a mix of advanced controls techniques and thrifty empiricism that they can use in providing efficient and effective engine control logic.

In state-of-the-art low emission gasoline vehicles, both evaporative emissions and tailpipe emissions have been reduced by more than 90% from previous uncontrolled levels. The reduction in evaporative emissions has been achieved largely by use of evaporative emission control systems that utilize a charcoal canister to store fuel vapors from the fuel tank, with periodic purging of the vapors into the air intake manifold of the engine where they are drawn into the engine cylinders and burned. However, the objective of further reducing the emissions to near zero levels gives rise to a conflict between the need for aggressive purging of the charcoal canister to control evaporative emissions and extremely precise control of engine Air/Fuel ratio for tailpipe emissions control. For example, the design of high pressure fuel injection systems has often included the use of high-flow re-circulation of fuel (pumped from the fuel tank to the engine and back to the tank). This would allow the fuel injectors to be maintained at lower operating temperatures, even in applications where underhood temperatures and fuel injector location would otherwise have resulted in excessive fuel injector temperatures. This has helped avoid phenomena such as vapor lock and is also considered desirable for the longevity and precision of the fuel injector. However, this fuel control approach is at odds with the need to keep tank temperatures low to avoid evaporative running losses in extreme conditions. In addition, new requirements for On-Board Refueling Vapor Recovery (ORVR), On-board Diagnostic (OBD II and EOBD) and real-time and high temperature evaporative emission testing have created a strong need to more capable purge strategies.

Traditionally, engine control systems have treated canister gases as a disturbance to the engine fueling and this often required compromise between the desire for improved evaporative emission control and the need for flawless driveability and fuel control in a variety of operating conditions and with a multiplicity of commercial fuels of varying quality. Steadily lower tailpipe emission requirements have made the more careful integration of vapor (purge) and liquid (fuel injector) delivery to the engine essential to robustly achieve the level of fuel control required for extremely low tailpipe emissions for both test cycle and real world conditions and fuels. Accordingly, engine control strategies have been proposed in which the calculation of the injector fuel quantity takes into account the quantity of purge fuel contained in the intake air ingested into the cylinder. See, for example, U.S. Pat. No. 5,596,972 to Sultan et al. In the Sultan et al. system, a physical hydrocarbon sensor is used to determine the concentration of fuel vapors in the purge gas and this estimate of the purge fuel vapor is used to determine the quantity of fuel to be delivered by the injector and to control the flow rate of purge gas into the intake manifold.

SUMMARY OF THE INVENTION

The present invention provides a fuel control system method and apparatus which estimates the fuel received from purging of an evaporative emission control system and accounts for this purge fuel in determining the amount of fuel to be injected. The fuel control system comprises both the evaporative emission control system and a fuel injection system. The fuel injection system includes an electronic control module (ECM), a mass airflow meter, idle air control valve, throttle position sensor, manifold absolute pressure (MAP) sensor, engine speed sensor, solenoid-operated fuel injector, and exhaust gas oxygen ($O_2$) sensor. The evaporative emission control system includes the ECM as well as a charcoal canister, canister vent valve, purge valve, fuel tank pressure sensor, and a fuel tank temperature sensor. The ECM operates under program control to determine the amount of fuel to be delivered by a fuel injector to the cylinder of an automotive or other internal combustion engine. The ECM also operates the purge valve to control purging of the charcoal canister and the engine's fuel tank.

In accordance with one aspect of the invention, there is provided a method for determining the concentration of fuel vapor contained in purge gas inducted into a cylinder of the engine during purging of the evaporative emission control system. The method includes the steps of:

- obtaining a data value representative of the concentration of purge fuel vapors in the purge gas,
- operating a purge valve to permit the purge gas to be drawn into the cylinder of the internal combustion engine,
- determining an additional amount of fuel to be injected into the cylinder using the data value,
- injecting the additional fuel into the cylinder, and
- adjusting the data value if the total amount of fuel provided to the cylinder is greater than or less than a desired amount of fuel.

The data value can represent the hydrocarbon concentration [HC] of the purge gas and, preferably, the adjusting step further comprises determining an error related to the difference between the total amount of fuel and the desired amount of fuel, and adjusting the data value using the error. The error can be determined using a measurement of the exhaust gases produced by combustion of the purge fuel and injected fuel. Separate hydrocarbon concentration estimates can be maintained for both the purge gas from the charcoal canister and the purge gas from the tank.

In accordance with another aspect of the present invention, the hydrocarbon concentration is updated iteratively during purge while closed loop corrections used in the fuel calculation are updated during periods when no purging occurs. This allows the closed loop corrections to be updated based on feedback that does not contain any purge-related error. As a result, the system avoids the large, erratic variations in the closed loop corrections that are seen in conventional fuel delivery systems.

In accordance with another aspect of the present invention, there is provided a fuel control strategy that applies wall wetting and closed loop corrections only to the non-purge portion of the total fuel delivered to the cylinder. Preferably, this is accomplished by using the hydrocarbon concentration to determine a purge equivalence ratio which represents the percentage of the total fuel quantity that comes from purge. Then, the non-purge portion of the total quantity of fuel can be determined and the wall wetting and closed loop corrections can be applied to that non-purge portion.

In accordance with yet another aspect of the present invention, the purge valve is controlled in a manner that provides better fuel control during transient conditions, especially those involving large decreases in the air intake flow rate. This involves the use of a purge factor that is used as an intermediate variable in the calculation of the duty cycle of the purge valve solenoid. The purge factor is initially given a small value and is increased in a manner that prevents the purge equivalence ratio from becoming too large during rapid decreases in air intake flow rate. It also causes purge massflow to be more proportional to airflow during rapid transients in airflow in either direction.

BRIEF DESCRIPTION OF THE DRAWINGS

A preferred exemplary embodiment of the present invention will hereinafter be described in conjunction with the appended drawings, wherein like designations denote like elements, and:

FIG. 7 is a table that depicts how the control system models the transport delay and smoothing of the purge gas as it moves between the throttle and the cylinder intake port;

DESCRIPTION OF THE PREFERRED EMBODIMENT

Figure 1:
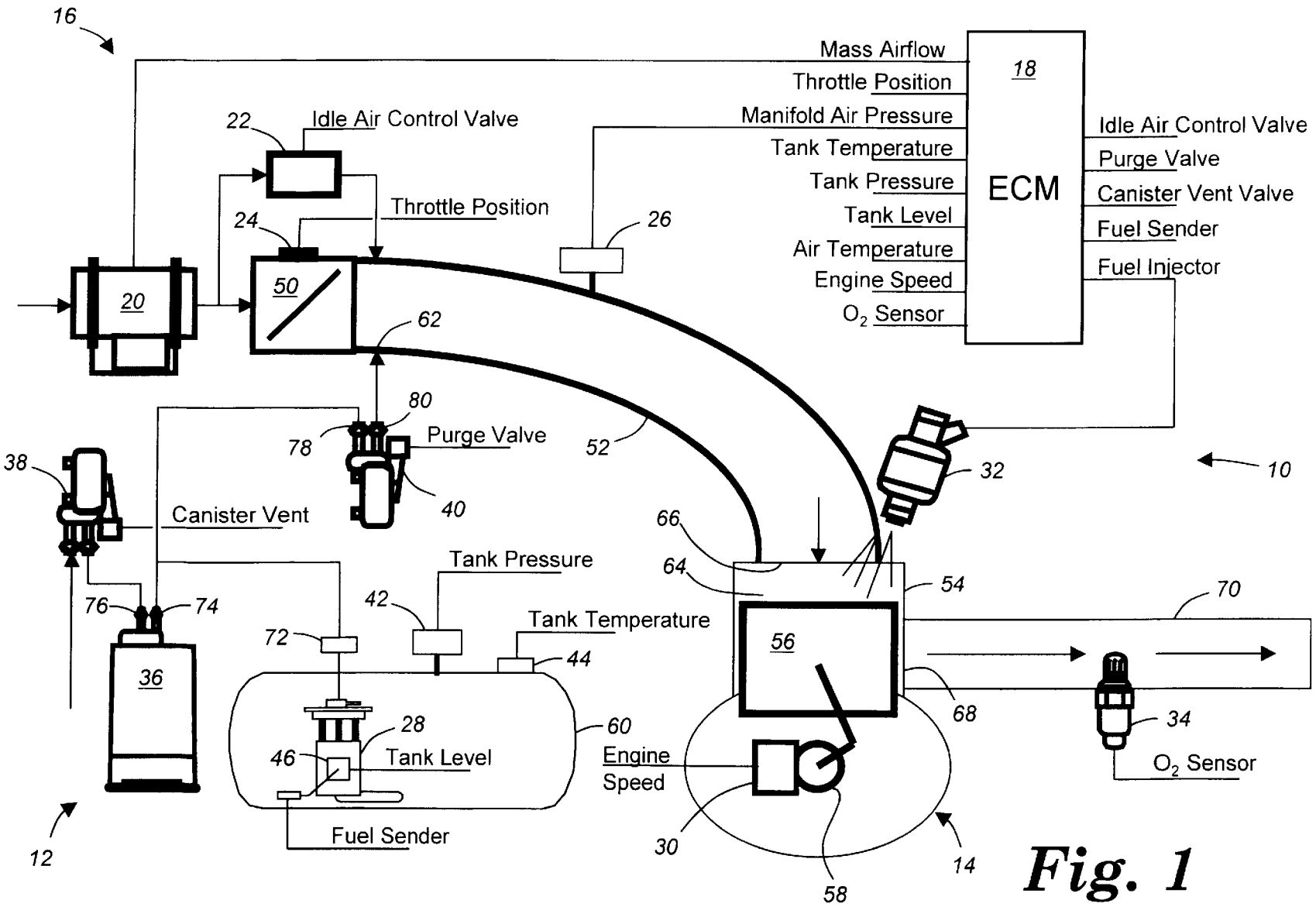
FIG. 1 is a diagrammatic view of a preferred exemplary embodiment of the invention, showing a fuel injection system and evaporative emission control system that are integrated together into a single fuel control system for an automotive internal combustion engine.

Referring to FIG. 1, there is shown a fuel injection system 10 and evaporative emission control system (EECS) 12 for an internal combustion engine 14. While fuel injection system 10 and EECS 12 can be implemented separately, in the preferred embodiment shown in FIG. 1 they are integrated together into a single fuel control system 16. In general, EECS 12 manages evaporative emissions from the stored fuel that is used to operate engine 14 and provides the vaporized fuel to engine 14 when necessary. Fuel injection system 10 determines the amount of fuel to be injected each engine cycle, taking into account any fuel vapors provided by EECS 12. In this way, evaporative emissions from the stored fuel can be used in engine operation, rather than being lost to the environment, and can be accounted for in the fuel calculations so that the engine 14 can be operated in a manner that minimizes exhaust emissions.

Fuel injection system 10 includes an electronic control module (ECM) 18, a mass airflow meter 20, idle air control valve 22, throttle position sensor 24, manifold absolute pressure (MAP) sensor 26, fuel sender 28, engine speed sensor 30, solenoid-operated fuel injector 32, and exhaust gas oxygen ($O_2$) sensor 34. EECS 12 includes ECM 18 as well as a charcoal canister 36, canister vent valve 38, purge valve 40, fuel tank pressure sensor 42, fuel tank temperature sensor 44, and a tank level sensor 46 that can be a part of fuel sender 28. The components of fuel injection system 10 and EECS 12 all form a part of fuel control system 16 and these components can be conventional parts connected together in a manner that is well known to those skilled in the art. As will be appreciated, fuel control system 16 may also include a number of other components known to those skilled in the art that can be used in a conventional manner to determine the quantity of fuel to be injected each cycle. Such components can include, for example, an engine temperature sensor and an air temperature sensor incorporated into or located near the airflow meter 20, neither of which is shown in FIG. 1.

ECM 18 contains the software programming necessary for implementing the evaporative emissions control, fuel quantity calculations, and fuel injection control provided by fuel control system 16. As will be known to those skilled in the art, ECM 18 is a microprocessor-based controller having random access and read-only memory, as well as non-volatile re-writable memory for storing data that must be maintained in the absence of power. ECM 18 includes a control program stored in ROM that is executed each time the vehicle is started to control fuel delivery to the engine. ECM 18 also includes suitable analog to digital converters for digitizing analog signals received from the various sensors, as well as digital to analog converters and drivers for changing digital command signals into analog control signals suitable for operating the various actuators shown in FIG. 1. ECM 18 is connected to receive inputs from airflow meter 20, throttle position sensor 24, MAP sensor 26, engine speed sensor 30, $O_2$ sensor 34, tank pressure sensor 42, tank temperature sensor 44, and tank level sensor 46. ECM 18 is connected to provide actuating outputs to idle air control valve 22, fuel sender 28, fuel injector 32, canister vent valve 38, and purge valve 40.

The components of engine 14 relevant to fuel control system 16 include an engine throttle 50, intake manifold 52, a number of cylinders 54 and pistons 56 (only one of each shown), and a crankshaft 58 for creating reciprocal motion of the piston within cylinder 54. Throttle 50 is a mechanical throttle that is connected downstream of airflow meter 20 at the entrance of intake manifold 52. Throttle 50 is controlled by the vehicle operator and its position sensor 24 is used to provide ECM 18 with a signal indicative of throttle position. Idle air control valve 22 provides a bypass around throttle 50, and it will be appreciated that an electronically-controlled throttle could be used in lieu of idle air control valve 22 and mechanical throttle 50. Purge valve 40 feeds purge air from charcoal canister 36 and/or fuel tank 60 into the intake manifold at a purge port 62 that is located just downstream of the throttle. Thus, the intake air that flows through manifold 52 comprises the air supplied by idle air control valve 22, purge valve 40, and throttle 50. MAP sensor 26 is connected to intake manifold 52 to provide the ECM with a signal indicative of gas pressure within the intake manifold. In addition to determine appropriate fuel quantities, it can be used to provide a reading of the barometric pressure, for example, prior to engine cranking.

At the cylinder end of intake manifold 52, air flows into a combustion chamber 64, which is merely the space within cylinder 54 above piston 56. The intake air flows through a valve (not shown) at the intake port 66 of the cylinder and then into the combustion chamber. Fuel injector 32 can be placed in a conventional location upstream of the intake port 66 or within the cylinder head in the case of direct injection. After combustion, the exhaust exits the cylinder through a valve (not shown) at an exhaust port 68 and is carried by an exhaust pipe 70 past $O_2$ sensor 34 and to a catalytic converter (not shown). As will be appreciated by those skilled in the art, this $O_2$ sensor can either be a wide-range air/fuel sensor or a switching sensor.

As shown in FIG. 1, evaporative emissions from the fuel in tank 60 are fed by way of a rollover valve 72 to a first port 74 of charcoal canister 36. These vapors enter canister 36, displacing air which is vented via a second port 76 to the atmosphere by way of canister vent valve 38. Port 74 is also connected to an inlet 78 of purge valve 40. The outlet 80 of this purge valve is connected to purge port 62 on the intake manifold. This allows fuel vapors from canister 36 and tank 60 to be supplied to the intake manifold via the purge valve 40. Purging of the canister and fuel tank is controlled by ECM 18 which operates purge valve 40 periodically to permit the vacuum existing in intake manifold 52 to draw purge gas from canister 36 and tank 60. Purge valve 40 is a solenoid-operated valve, with ECM 18 provided a duty cycled controlled signal to regulate the flow rate of purge gas through valve 40. When the canister vent valve 38 is open during purging, fresh air is drawn into the canister via the vent valve and port 76, thereby allowing the fuel vapors to be drawn from the canister. When the canister vent valve is closed, the introduction of fresh air through port 76 is blocked, allowing fuel vapors to be drawn from the tank 60. This purge-on, vent-closed state is generally done for the purpose of diagnostics of the fuel tank 60 and EECS 12.

As will be described below, for each combustion occurring in each cylinder (i.e., for each combustion event), fuel control system 10 determines the appropriate control signal to operate injector 32 so that the desired amount of fuel will be present within cylinder 54 for its next combustion. As is known, the desired quantity of fuel for combustion depends upon the mass airflow ingested by the cylinder (designated as $m_{port}$), the desired air/fuel ratio (AFR), as well as a number of factors, and the determination of this quantity is well known to those skilled in the art. As a part of the fuel calculation, various corrections are made to this desired total quantity of fuel to obtain a final injector quantity which represents the amount of fuel to be delivered by the injector and which is therefore used in generating the injector control signal. One of these corrections is a wall wetting correction that is a function of the fraction of fuel that impacts the wall of the manifold instead of vaporizing (denoted X) and the time constant of evaporation of the puddle of fuel which accumulates on the manifold wall from current and prior injections (denoted $\tau$). Another of these corrections is a set of closed loop corrections based upon feedback from the $O_2$ sensor 34. Feedback from the $O_2$ sensor provides data indicative of the relative leanness or richness of the combustion and this data is compared with the desired AFR for the combustion to determine an error. This error is used to provide fast, closed loop proportional feedback ($ke_i$) for each combustion event i. This error is also integrated ($\int e_i dt$) and both the proportional and integral error terms are used to provide corrections to the fuel injector quantity calculation.

Figure 2:
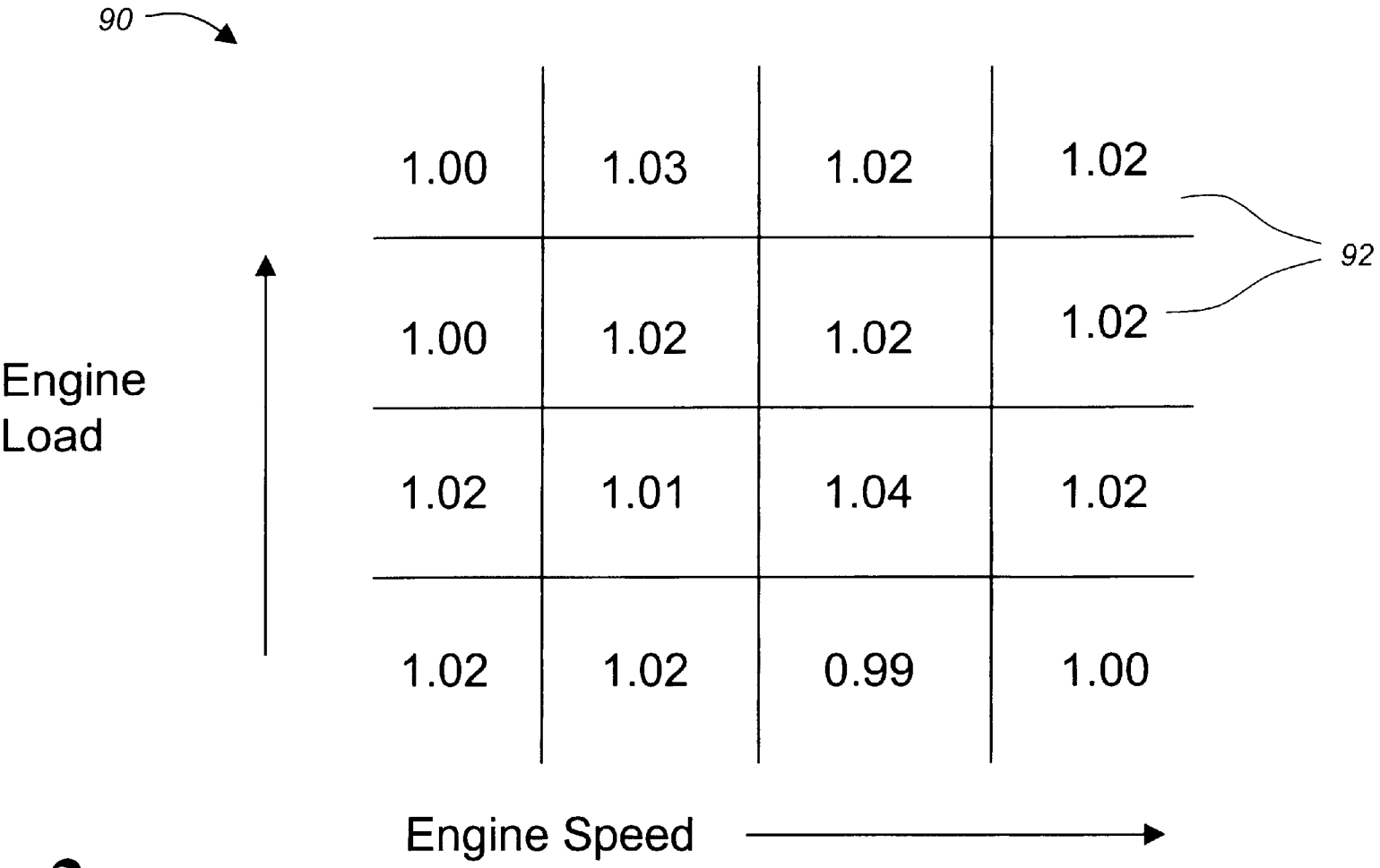
FIG. 2 depicts a block learn memory used in the electronic control module of FIG. 1 to provide system corrections based on engine load and speed.

The integrated error is also used to update a block learn memory stored in ECM 18. Referring now to FIG. 2, an exemplary block learn memory (BLM) 90 is shown which is used to provide a correction to the factory fuel calibration to thereby account for changing characteristics of the components in the fuel system that affect the quantity of fuel delivered. Since the error introduced by these components can be engine speed and load dependent, BLM 90 is implemented as a look-up table having a matrix of cells 92 that permit separate corrections to be applied as a function of both engine speed and engine load. Each of these cells contains a correction factor, which is a data value that is applied during the fuel calculation by, for example, multiplying it with the calculated fuel quantity. The BLM is stored in memory and, unlike the proportional or integral error, is maintained from one trip to the next. It is gradually adjusted over the course of the life of the vehicle using the integrated error term. As will be discussed below, in the illustrated embodiment of the invention, BLM 90 is updated in accordance with the integral error term during periods when no purge of canister 36 or fuel tank 60 is being carried out.

As mentioned above, purging of either canister 36 or fuel tank 60, or both, results in the injection of purge gases containing fuel vapors into the air intake manifold. This adds to the total fuel ingested into the cylinder and, in the illustrated embodiment, the amount of fuel contributed by the purge gas is estimated and accounted for in determining the amount of additional (non-purge) fuel to be added by the injector. Estimation of the amount of fuel supplied by the purge gas is accomplished without the use of a physical hydrocarbon sensor; rather, it is accomplished using an iteratively updated estimate of the concentration of fuel vapor in the purge gas. This hydrocarbon concentration (denoted [HC]) of the purge gas is stored in memory as a data value that is updated in much the same manner as the BLM. That is, it is updated based upon the integrated error term $\int e_i dt$ during purge. Since the fuel vapors from the purge gas are vaporized and are not supplied by the fuel injection system itself, the wall wetting and block learn memory corrections are only applied to the non-purge portion of the total fuel delivered. Also, to prevent errors in the estimate of the hydrocarbon concentration [HC] from adversely affecting the adaptation of the block learn memory, updates to the block learn memory are, with one exception to be described below, only made during periods when no purging occurs.

Figure 3:
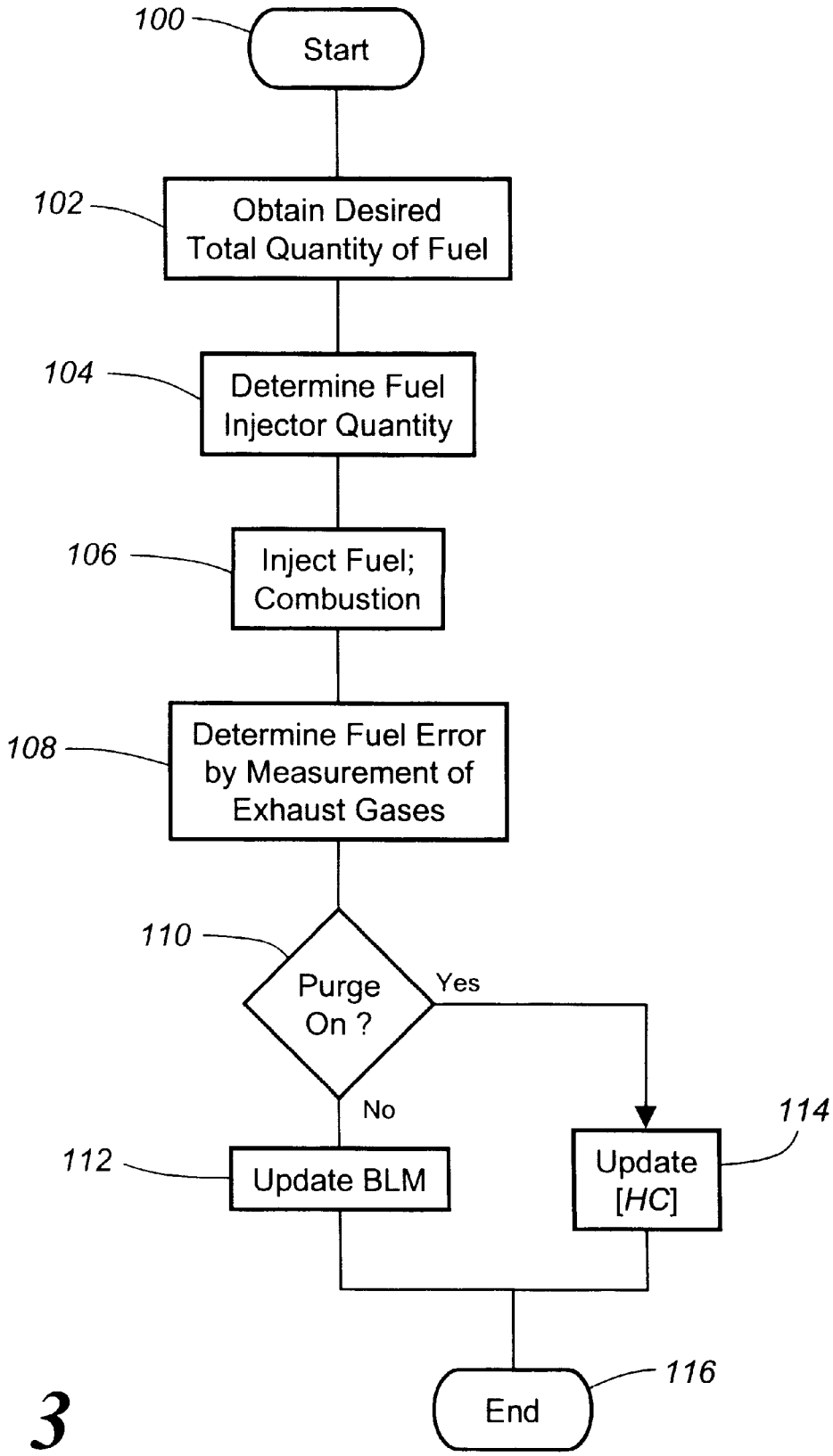
FIG. 3 is a flow chart showing the operation of the fuel control system of FIG. 1 over the course of a single combustion cycle for one of the cylinders of the engine.

Turning now to FIG. 3, there is shown a flow chart representing the operation of ECM 18 under program control to determine the amount of fuel required for a single combustion event and to update the block learn memory and [HC] estimate. The process begins at start block 100 and moves to block 102 where the desired total quantity of fuel for the combustion is obtained. As discussed above, the process for determination of this quantity is well known to those skilled in the art and no further elaboration will therefore be provided herein. The next step is at block 104 where the quantity of fuel to be delivered by the fuel injector 32 is determined. In the event that purge valve 40 is closed (i.e., during periods when no purging occurs), the fuel calculation can simply be carried out in a conventional manner. During purging, however, the hydrocarbon concentration [HC] estimate is used to determine the portion of the desired total fuel that is supplied by the purge gas so that the amount of non-purge fuel needed can be determined and, from this, the amount of fuel to be supplied by the injector can be calculated. Once the fuel injector quantity is known, the appropriate control signal for the fuel injector 32 can be generated and used to operate the fuel injector to supply fuel to the cylinder 54. In the illustrated embodiment, fuel injector 32 is solenoid operated using pulse width modulation and the delivery of fuel is controlled by control of the pulse width. Accordingly, the determination of the amount of fuel to be supplied by injector 32 can be accomplished by determining a desired injector on-time without having to first determine the desired mass of fuel to be injected.

Next, the fuel is injected and combustion takes place, as indicated at block 106. Thereafter, the exhaust gases are monitored by $O_2$ sensor 34 and the proportional and integral error terms are calculated, as indicated at block 108. The process then moves to block 110 and, if the purge valve is closed, the process moves to block 112 where the integrated error is used to determine what, if any, adjustment should be made to the data in block learn memory 90. If the purge valve is open, the process moves to block 114, where the integrated error is used to update the hydrocarbon concentration [HC], if needed. In either case, the process then moves to block 116 where the process ends for the current combustion event. The updating of BLM values at block 112 can be carried out in a conventional manner. This is often accomplished by determining whether the magnitude of the integrated error exceeds a threshold value and then making an incremental adjustment (either positive or negative) to the appropriate cell data value(s). The updating of the [HC] estimate at block 114 can be carried out in the same manner, except that the step size of the increment to the [HC] data value should be selected such that the magnitude and rate of the change in fuel delivered to the cylinder as a result of the change should be substantially the same or equal to the magnitude and rate of the change in fuel delivered due to a single increment of the BLM values. Thus, for example, if a change of 0.01 in a BLM value results in a 1% change in the total quantity of fuel delivered, then the incremental adjustment to the [HG] data value should be selected so that it also results in a 1% change in the total quantity of fuel delivered. This often means that [HG] is updated in steps of greater than 1%, as the purge mass flow is often very small compared to the total engine airflow.

The updating of the [HC] estimate allows the system to adaptively learn the concentration of fuel in the purge gas to a reasonable level of accuracy without the need for a physical sensor. Separate [HC] estimates are maintained and used by ECM 18 for both the canister 36 and fuel tank 60. This is done according to the state of the canister vent valve 38. If it is open during purge, then, the purge gas delivered to intake manifold 52 mostly comes from canister 36 and, accordingly, the canister [HC] estimate is used and updated as a part of the fuel calculation. Conversely, if the canister vent valve is closed during purge, then the purge gas mostly comes from tank 60 and, accordingly, the tank [HC] estimate is used and updated. This allows the system to maintain accurate, stable estimates of each of the concentrations which can then be used to determine the appropriate amount of fuel to be delivered by the injector for each combustion event.

By preventing updating of the BLM during purging, fuel control system 16 avoids the large, erratic variations in BLM values that are seen in conventional fuel delivery systems. This results in much more stable BLM values, even in extreme purge conditions. It should be noted that in some instances it is desirable to adjust one or more of the BLM values during purge; namely, when the hydrocarbon concentration [HC] is at one of it's extremes (i.e., either 0% or 100%) and the feedback attempts to adjust it outside of it's natural limits. Thus, for example, if [HC]=0% and the feedback indicates that the combustion is still too lean, then the system will make a suitable adjustment to the appropriate BLM value(s) notwithstanding the fact that a purge is currently in process.

In the illustrated embodiment, the [HC] estimate is used to generate a purge equivalence ratio ($\phi_{purge}$) which represents the percentage of the desired total quantity of fuel that is provided by the purge gas. By determining this amount, the non-purge portion of the total fuel quantity can be easily computed. The purge equivalence ratio can be calculated from the [HC] estimate, the desired air/fuel ratio (AFR), the purge gas mass flow rate ($\dot{m}_{purge}$) estimate, and the intake mass airflow rate ($\dot{m}_{intake}$) estimate, as follows:

$$\phi_{purge} = \frac{[HC] \cdot \dot{m}_{purge} \cdot AFR}{\dot{m}_{intake}}$$

The AFR is determined in a conventional manner by the ECM 18 as a part of determining the desired total quantity of fuel. The purge mass gasflow rate $\dot{m}_{purge}$ can be measured or estimated based on various factors, such as the duty cycle of the purge valve control signal, the temperature of the purge gas, and the pressure across the purge valve. Similarly, the intake mass airflow rate $\dot{m}_{intake}$ can be measured or estimated. If desired, these mass airflow rates can be estimated using the technique disclosed in U.S. Pat. No. 5,845,627, issued Dec. 8, 1998 to Olin et al., the entire contents of which are hereby incorporated by reference.

Figure 4:
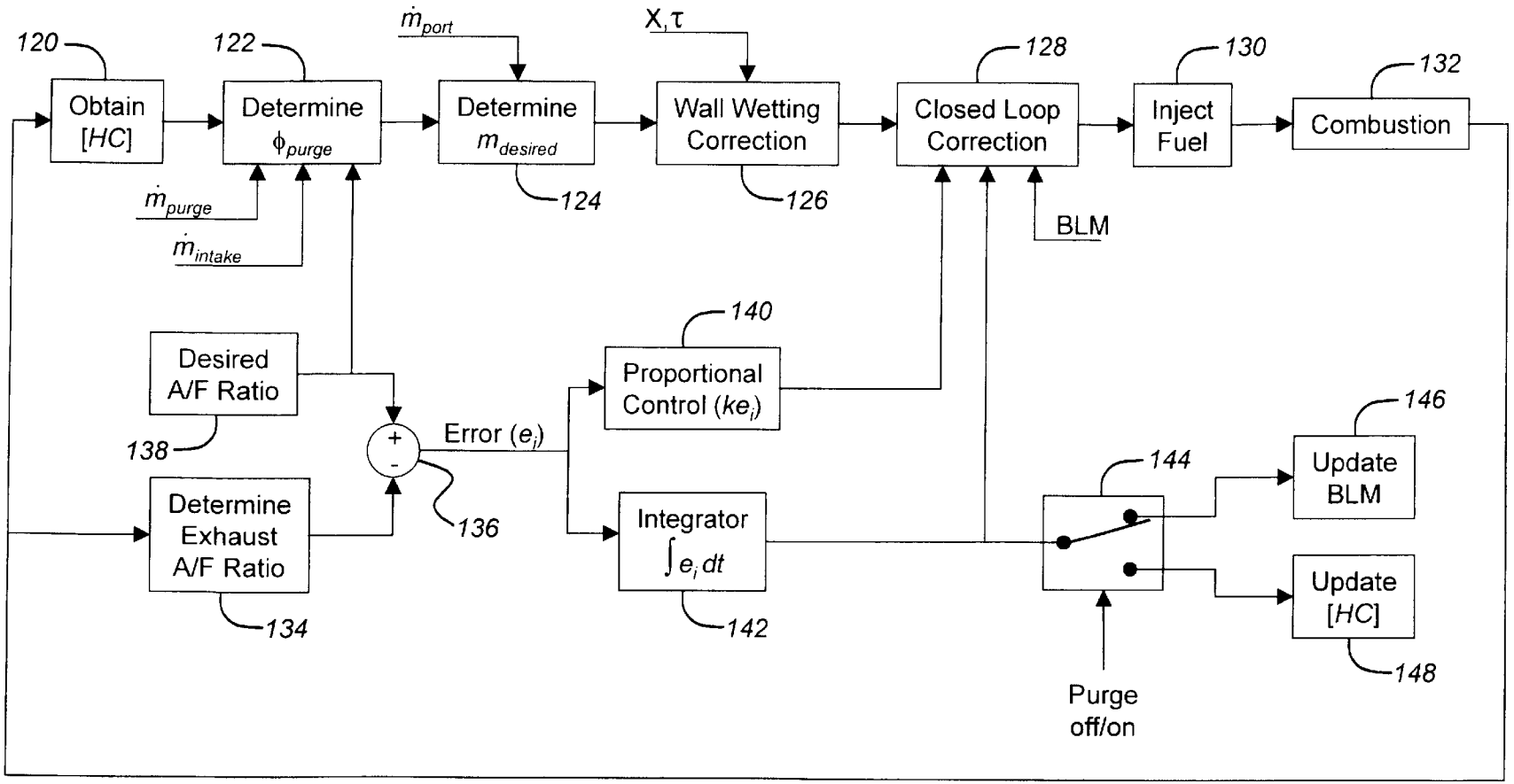
FIG. 4 is a process diagram depicting the fuel control strategy of the fuel injection system of FIG. 1.

Referring now to FIG. 4, there is shown the process carried out by the fuel injection system for each combustion event of a single cylinder. The process begins with the fuel calculation which, during purge, begins at block 120. First, the [HC] value is obtained from memory. Then, at block 122 the purge equivalence ratio $\phi_{purge}$ is determined using the equation given above. Once the purge equivalence ratio has been calculated, the desired amount ($m_{desired}$) of non-purge fuel required for combustion can be determined using $\phi_{purge}$, the engine firing frequency (f), and the known desired total quantity of fuel (which is represented by the estimated mass flow rate ($\dot{m}_{port}$) of air ingested by the cylinder). This calculation is carried out at block 124 and has the form of:

$$m_{desired} = \frac{\dot{m}_{port}}{f} \cdot (1 - \phi_{purge})$$

where $(1-\phi_{purge})$ represents the non-purge fuel portion of the total quantity of fuel.

Next, at block 126, the wall wetting corrections are made. These corrections are well known in the art and take the form of:

$$m_{corr}=m_{desired} \cdot f(X,\tau)$$

where $f(X,\tau)$ generally represents a term that is a function of X and $\tau$.

Then, at block 128, the proportional, integral, and BLM closed loop corrections are applied to produce the final fuel injector quantity ($m_{inj}$). As with the wall wetting corrections, these corrections are applied in a known manner that takes the form of:

$$m_{inj}=m_{corr} \cdot f(ke_i, \int e_i dt, BLM).$$

Once the injector fuel quantity is determined, the appropriate pulse width modulated control signal is applied to the injector to deliver the fuel to the cylinder, as indicated at block 130. Combustion then takes place, as indicated by block 132, following which the process moves to block 134 for updating of the appropriate stored data values. The process also returns to block 120 for another cycle once the stored data values have been updated. The error $e_i$ is determined at node 136 which is essentially a subtraction of the measured air/fuel ratio (determined from the exhaust gases using $O_2$ sensor 34) from the desired air/fuel ratio depicted at block 138. As discussed above and as shown at block 140, this error is multiplied by a proportionality factor k for the purpose of provided proportional closed loop feedback. It is also integrated at block 142 to generate the integral term used for both closed loop corrections and for updating either the [HC] or BLM. If no purge is currently being performed, as indicated at block 144, then the integrated error term feedback is used to update the BLM at block 146. If purge gases are present, then the integrated error term is used to update the [HC] estimate at block 148.

Thus, it will be appreciated that by iteratively updating the canister and tank [HC] estimates during purging, the amount of fuel contained in the purge gas delivered to the cylinder can be determined and used in the fuel calculation to enable an accurate calculation of the amount of non-purge fuel needed. Moreover, the wall wetting and closed loop corrections are only applied to non-purge portion of the total fuel quantity, thereby avoiding the introduction of fuel system modeling errors that would otherwise adversely influence the adaptation of the BLM values. Furthermore, the iteratively-learned [HC] estimate can be used along with the estimated mass flow rate of the purge gas $\dot{m}_{purge}$ to calculate an estimated purge mass airflow rate $\dot{m}$purgeairaccording to the following equation:

$$\dot{m}_{purgeair}=(1-[HC])\dot{m}_{purge}.$$

This estimated airflow rate can be used by ECM 18 for transient compensation of the calculated fuel quantities when switching of the purge valve 40 on and off. When an idle air control valve or electronic throttle is used, this estimated purge airflow rate could be used by the ECM to adjust the intake airflow to account for the loss or gain of airflow when the purge valve is turned off and on, respectively.

Figure 5:
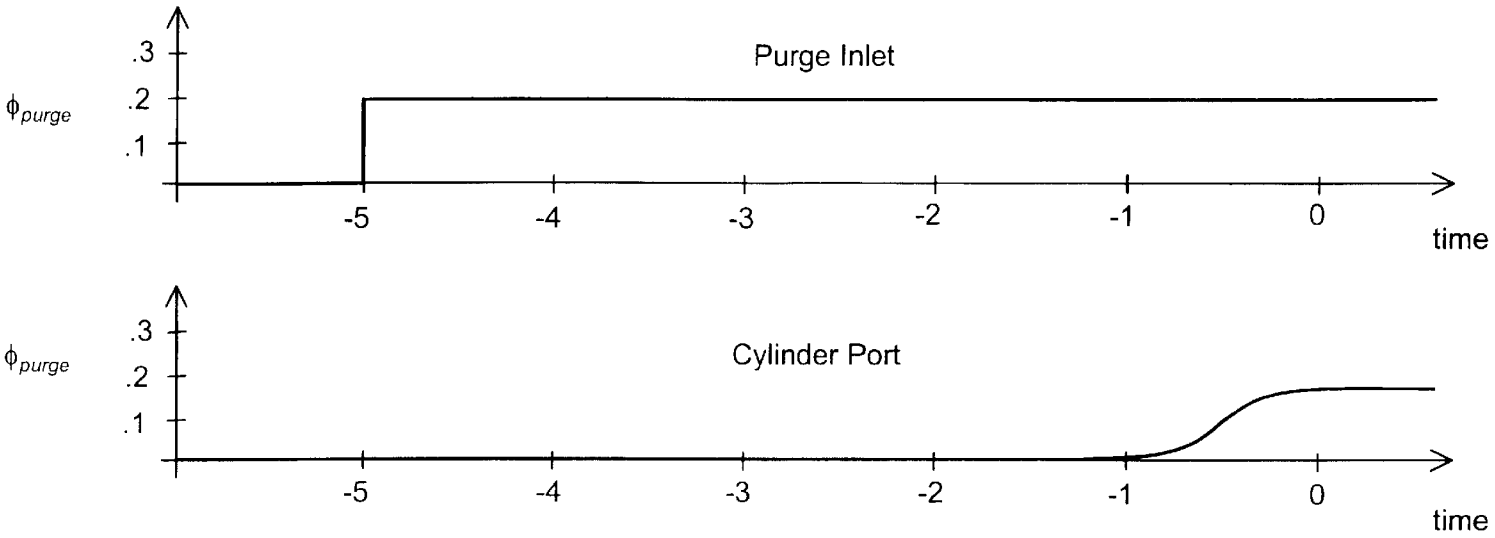
FIG. 5 depicts a pair of graphs showing the transport delay and smoothing of purge gas that occurs between injection of the purge gas at the throttle and the ingestion of the purge gas at the cylinder's intake port.

Referring back momentarily to FIG. 1, it will be appreciated that when the purge gas is drawn into intake manifold 52 through purge port 62, there is a propagation delay that is equal to the amount of time needed for the purge gas to flow from the purge port to the cylinder intake port 66. During steady state purging, this delay is of no effect. However, when switching purge valve 40 at the beginning or end of a purge cycle, this transport delay must be accounted for in the fuel calculation since, for example, when switching the purge valve on, the fuel vapors from the purge gas may not appear in the cylinder for several combustion cycles. This can be seen in FIG. 5, which shows two graphs representing examples of the purge equivalence ratio $\phi_{purge}$ as a function of time at two places, with the top graph representing $\phi_{purge}$ at the purge port 62 and the bottom graph representing $\phi_{purge}$ at the intake port 66. As can be seen by an inspection of these graphs, there is a delay of approximately five combustion events between when the purge gas exits valve 40 into the manifold and when it enters cylinder 54 through the intake port. Moreover, as the charge of purge gas propagates along the manifold, it diffuses somewhat such that the purge front shown in the top graph is smoothed to some degree by the time it enters the cylinder. As shown by the two graphs of FIG. 6, this smoothing effect is a function of the residence time in manifold 52. At higher engine rpm's, the air moves more quickly through the manifold, giving the purge gas front less time to smooth out. Conversely, at lower speeds, the purge gas has more time to diffuse into the other intake air downstream of the front.

To account for the transport delay and smoothing of the purge gas as it traverses the manifold, a ring buffer is used to model the transport delay, with the data in the ring buffer being filtered at regular time intervals. The ring buffer is used to delay and filter the purge equivalence ratio $\phi_{purge}$ prior to its use in determining the desired non-purge fuel quantity $m_{desired}$ at block 124 of FIG. 4. This ring buffer can be implemented in RAM by ECM 18 as a linear array of memory locations, each of which represents a point along the length of the intake manifold between the purge port 62 and intake port 66. Each newly computed value of $\phi_{purge}$ is inserted into the buffer at a memory location identified by a pointer, with the pointer then being changed to point to the next location in the buffer, overwriting the oldest data in the buffer. As will be appreciated, the memory location at which the newest value of $\phi_{purge}$ is inserted represents the value of $\phi_{purge}$ at the purge port, whereas the value of $\phi_{purge}$ at the intake port that is used in the fuel calculation is determined by an interpolated look-up in the buffer of a value located a particular number of events before the current event, with this particular number representing the transport delay.

Figure 8:
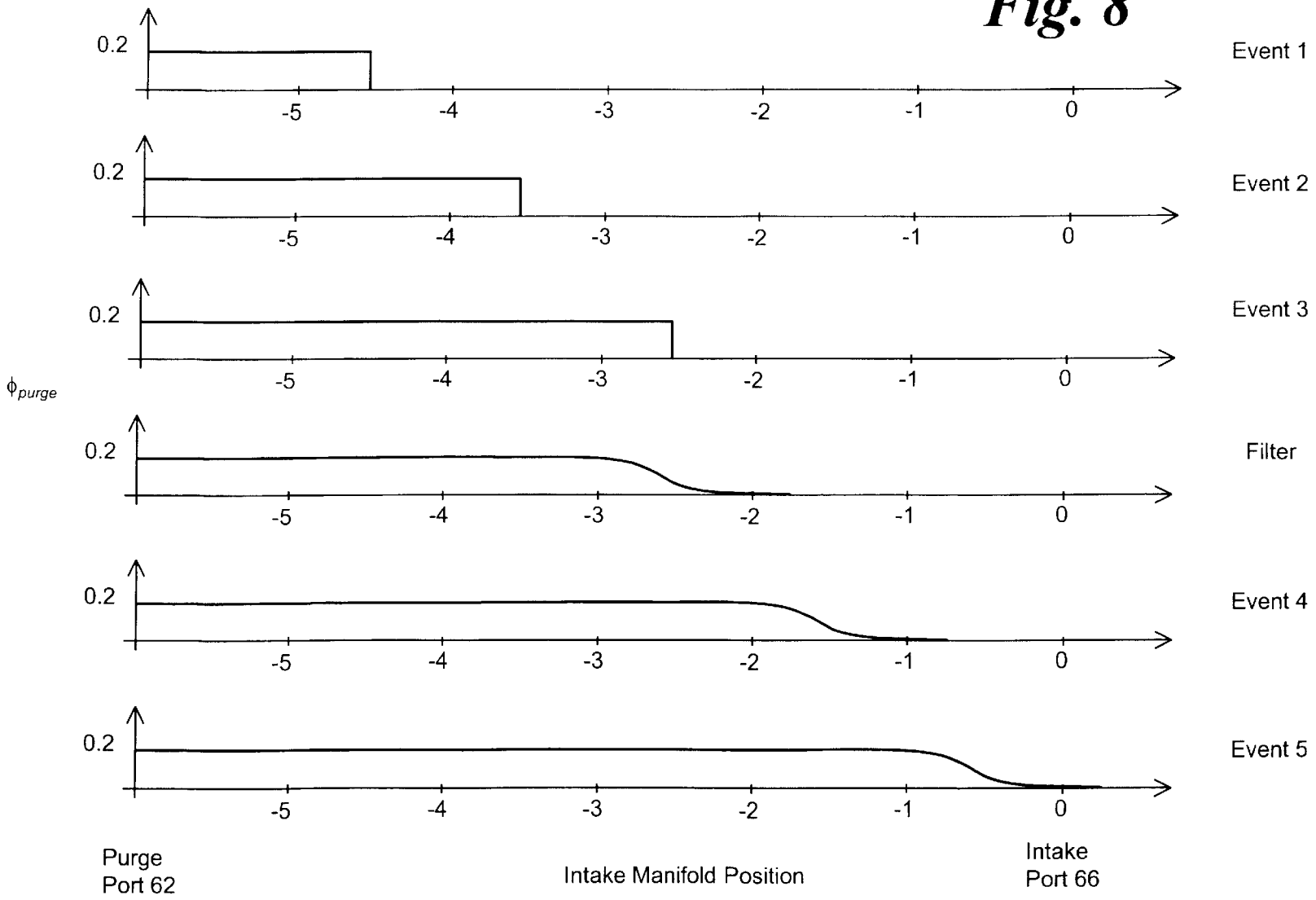
FIG. 8 is a set of graphs that together depict the propagation and filtering of the purge equivalent ratio that is provided by the modeling depicted in FIG. 7.

The shifting of the pointer for the ring buffer is done on the basis of combustion cycles whereas the filtering of the data in the buffer is done on a time basis. This can be understood by reference to FIGS. 7 and 8. FIG. 7 depicts a table containing six columns representing six different points along the length of the intake manifold between the purge port 62 and intake port 66. Each of the numbered rows of the table represents a different combustion event. FIG. 8 is a graphical representation of the data of FIG. 7 and includes a separate graph for each row of the table of FIG. 7. As can be seen, the purge valve has been opened just prior to the first combustion event, resulting in a purge equivalence ratio $\phi_{purge}$ of 20% at the purge port. At this point, $\phi_{purge}$ at the intake port is still zero. Then, when combustion event 2 occurs, the purge gas front has propagated to a position just downstream of the purge port. At event 3, the front has moved further downstream. Then, at some timed interval, low-pass filtering will be applied to all of the data in the buffer, resulting in a change to the data values, such as is shown in FIG. 7. For each memory location in the buffer, the data at that location is filtered using the data stored in the two locations adjacent that memory location. This filtering can be done according to the equation:

$$\phi_n(\text{new})=\phi_n(1-2m)+\phi_{n-1}m+\phi_{n+1}m,$$

where n represents the memory location within the ring buffer and m represents a scalar factor that defines the degree of filtering. Other suitable filtering techniques will be apparent to those skilled in the art. Over the course of combustion events 4 and 5, this smoothed front will propagate the rest of the way to the intake port, at which point the data extracted from the buffer for the fuel calculation becomes non-zero and begins to have an effect on the fuel calculation.

Figure 6:
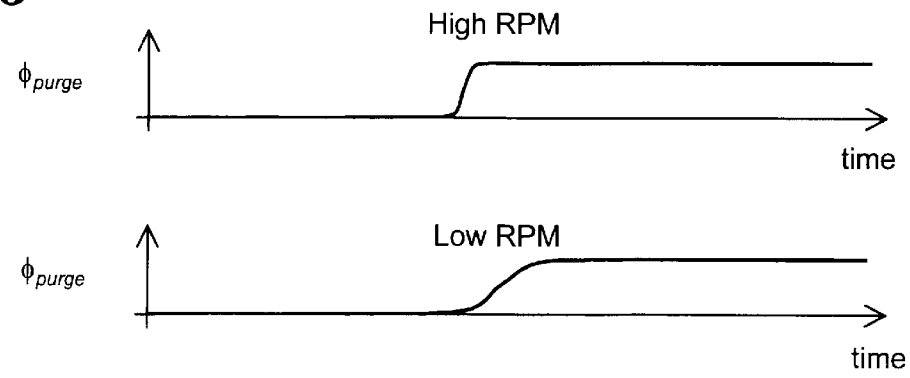
FIG. 6 depicts a pair of graphs showing the effect of engine speed on the smoothing of the purge gas.

As will be appreciated, by stepping through the ring buffer on the basis of combustion events while filtering on the basis of time, the smoothing characteristics shown in FIG. 6 can be modelled. For higher engine speeds, the data moves through the buffer quickly and may only be filtered once, as shown in FIGS. 7 and 8. For lower engine speeds, there is more time between combustion events and the data will be filtered more times, resulting in greater smoothing of the purge gas front.

Figure 9:
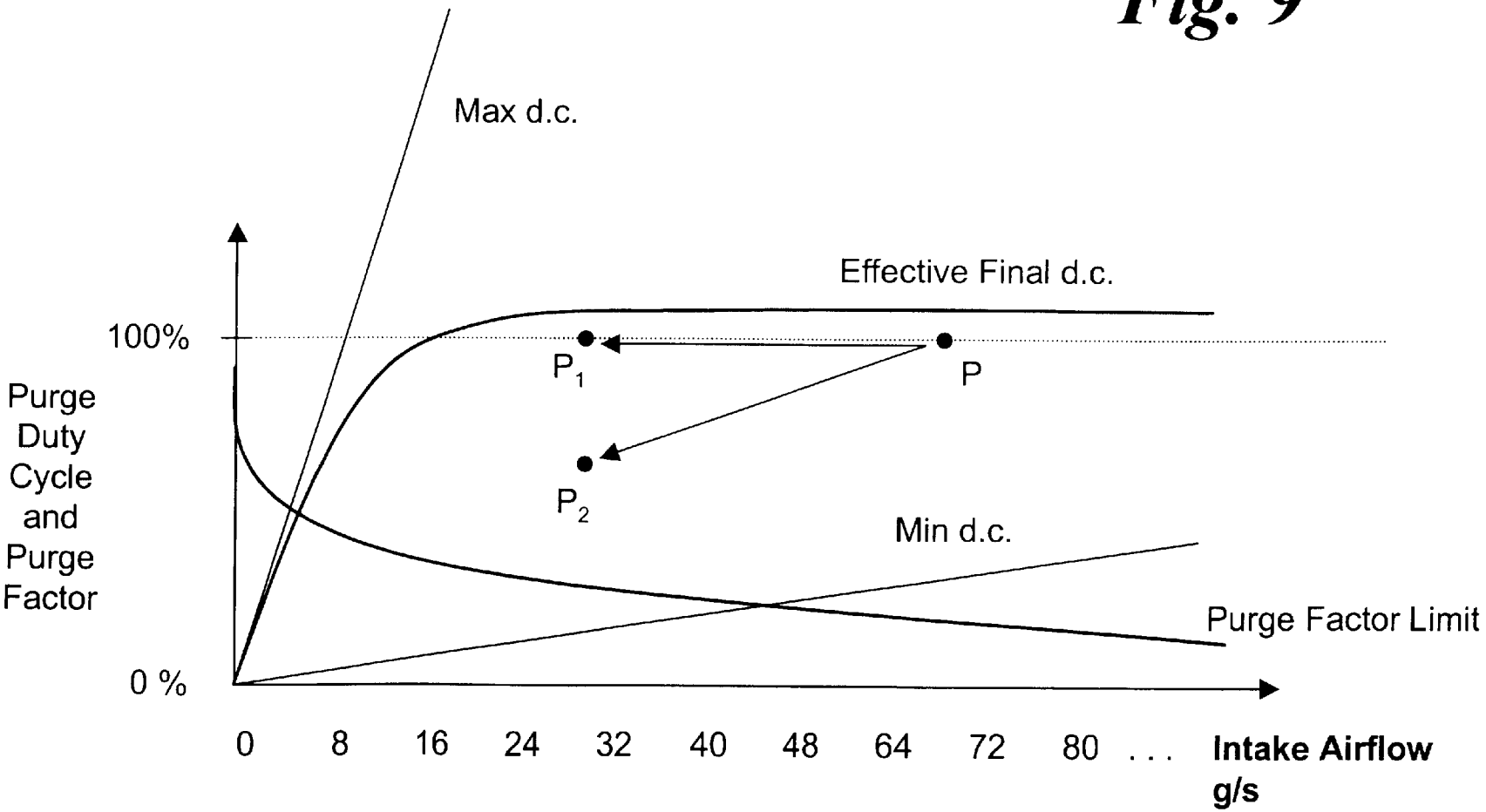
FIG. 9 is a graph showing the relationship between intake airflow rate and duty cycle limit of the purge valve solenoid used in the evaporative emission control system of FIG. 1, with the graph further depicting a purge factor and its effect on the duty cycle of the solenoid.

Turning now to FIG. 9, there will now be described a process used by ECM 18 for limiting the duty cycle of the purge valve solenoid during transient conditions to prevent excessive purge equivalence ratios that could otherwise cause large errors between the desired total quantity of fuel and the actual quantity delivered. This limiting of the duty cycle (dc) is accomplished using a purge factor (pf) which is applied in a manner that can reduce engine fueling errors under certain conditions, such as when a large decrease in intake airflow occurs. As shown in FIG. 9, the solenoid duty cycle is typically limited to a maximum value (max) that varies somewhat linearly with the intake airflow. The solenoid duty cycle may also have a set minimum value (min), as shown, which can also be a function of intake airflow. Generally, evaporative emission control systems are designed to purge as aggressively as other conditions allow. Thus, when the intake airflow is sufficiently high, the duty cycle of the purge solenoid will typically be ramped up to 100% duty cycle, as shown at point P in FIG. 9. In conventional systems, which do not utilize a purge factor, a relatively large decrease in intake airflow rate may not result in any decrease in solenoid duty because the theoretical maximum duty cycle (max) is still above 100%. This is shown point $P_1$ in FIG. 9. Since the total fuel required is reduced at the lower intake airflow, this 100% purge solenoid duty cycle can cause the purge equivalence ratio $\phi_{purge}$ to become quite large and errors in the hydrocarbon concentration [HC] will become undesirably significant.

In the illustrated embodiment, the purge factor is used to prevent this situation from occurring. The purge factor is a scalar multiplier between zero and one, and is applied according to the following equation:

$$dc=pf(max-min)+min.$$

When purging is begun, the purge factor is set to a small value and is then ramped up towards a maximum value that is a function of intake airflow. This purge factor limit is used to offset the effect of the theoretical maximum duty cycle, which can exceed 100% so that the effective final duty cycle limit resulting from the above equation is at or slightly above 100%, as shown. The effect of the purge factor is that changes in intake airflow rate that would not otherwise change the duty cycle of the solenoid will now result in a somewhat proportional change. Thus, as shown in FIG. 9, following a decrease in intake airflow from the Point P, the calculated duty cycle will drop to point $P_2$ due to the multiplication of the purge factor with the lowered maximum duty cycle.

It will thus be apparent that there has been provided in accordance with the present invention a fuel control system which achieves the aims and advantages specified herein. It will of course be understood that the foregoing description is of a preferred exemplary embodiment of the invention and that the invention is not limited to the specific embodiment shown. Various changes and modifications will become apparent to those skilled in the art and all such variations and modifications are intended to come within the scope of the appended claims.

We claim:

1. A method of controlling the amount of fuel injected into a cylinder of an internal combustion engine to account for fuel vapors contained in purge gas inducted into the cylinder during purging of an evaporative emission control system that includes a charcoal canister which stores evaporative emissions from a fuel tank, the method comprising the steps of:

determining a first data value that is related to the concentration of fuel vapors contained in the purge gas, obtaining a second data value that is related to a desired total quantity of fuel to be delivered to the cylinder, using said first and second data values to determine a third data value that relates to an amount of non-purge fuel to be delivered to the cylinder during purging of the charcoal canister, determining a fourth data value that is related to an amount of fuel to be supplied by a fuel injector, wherein said fourth data value is determined by applying one or more corrections to said third data value, and operating the fuel injector using a fuel injector control signal that is determined using said fourth data value;

wherein the step of determining a first data value further comprises determining said first data value using a fifth data value that is indicative of the concentration of fuel vapors contained in the purge gas, and wherein said fifth data value is determined using closed loop feedback during purging with said closed loop feedback including multiple iterations of the following steps:

determining an error representing the magnitude of the difference between a desired air/fuel ratio and a feedback value obtained by measurement of gases exhausted from the cylinder following combustion; and updating said fifth data value based on the error.

2. The method of claim 1, wherein said first data value comprises a purge equivalence ratio that represents the percentage of total fuel delivered to the cylinder that is contained in the purge gas.

3. The method of claim 2, wherein said step of determining a first data value further comprises calculating the purge equivalence ratio using said fifth data value.

4. The method of claim 1, wherein said updating step further comprises integrating the error and adjusting said fifth data value if the magnitude of the integrated error exceeds a threshold value.

5. The method of claim 2, wherein said step of determining a first data value further comprises calculating the purge equivalence ratio in accordance with the following equation:

$$\phi_{purge} = \frac{[HC] \cdot \dot{m}_{purge} \cdot AFR}{\dot{m}_{intake}}$$

where: $\phi_{purge}$=the purge equivalence ratio,

[HC]=the concentration of fuel vapors contained in the purge gas, $\dot{m}_{purge}$=the mass airflow of the purge gas, AFR=a desired air/fuel ratio, and $\dot{m}_{intake}$=the mass airflow of intake air.

6. The method of claim 1, wherein said step of determining a fourth data value further comprises applying a wall wetting correction to said third data value, whereby said wall wetting correction is only applied to the non-purge fuel portion of the total quantity of fuel being delivered to the cylinder.

7. The method of claim 1, wherein said step of determining a fourth data value further comprises applying a closed loop correction to said third data value, and wherein the method further comprises the step of using said closed loop feedback to iteratively update said closed loop correction during periods when no purging occurs, whereby said closed loop control is used to update the data value indicative of purge fuel during purging and is used to update the closed loop correction during periods when no purging occurs.

8. The method of claim 7, wherein said closed loop correction comprises data stored in a block learn memory.

9. The method of claim 1, wherein said closed loop feedback comprises an integral error term, and wherein the method further comprises the step of generating said integral error term by determining the air/fuel ratio of exhaust gases ejected from the cylinder after combustion, calculating the error between said air/fuel ratio and a desired air/fuel ratio, and summing the error with an integral error term determined during a previous iteration of said closed loop feedback.

10. A method of controlling the amount of fuel injected into a cylinder of an internal combustion engine to account for fuel vapors contained in purge gas inducted into the cylinder during purging of an evaporative emission control system that includes a charcoal canister which stores evaporative emissions from a fuel tank, the method comprising the steps of:

determining a first data value that is related to the concentration of fuel vapors contained in the purge gas, determining a second data value that is related to the amount of non-purge fuel to be delivered to the cylinder, calculating a third data value using said second data value and a closed loop correction factor, injecting fuel into the cylinder for subsequent combustion, wherein the quantity of injected fuel is determined in accordance with said third data value, generating a closed loop feedback using a measurement of gases exhausted from the cylinder following combustion, and using said feedback to iteratively update said first data value during purging and to iteratively update said correction factor during periods when no purging occurs;

wherein said first data value is bounded by an upper and lower limit, and wherein said correction factor is updated during purging only if said first data value is at either said upper or lower limit.

11. The method of claim 10, wherein said closed loop correction factor comprises a data value stored in block learn memory.

12. A method of controlling the amount of fuel injected into a cylinder of an internal combustion engine to account for fuel vapors contained in purge gas inducted into the cylinder during purging of an evaporative emission control system that includes a charcoal canister which stores evaporative emissions from a fuel tank, the method comprising the steps of:

determining a first data value that is related to the concentration of fuel vapors contained in the purge gas, determining a second data value that is related to the amount of non-purge fuel to be delivered to the cylinder, calculating a third data value using said second data value and a closed loop correction factor, injecting fuel into the cylinder for subsequent combustion, wherein the quantity of injected fuel is determined in accordance with said third data value, generating a closed loop feedback using a measurement of gases exhausted from the cylinder following combustion, and using said feedback to iteratively update said first data value during purging and to iteratively update said correction factor during periods when no purging occurs;

wherein said first data value comprises a purge fuel concentration value; and wherein updates to said correction factor and purge fuel concentration value are done incrementally, with the size of the increment for said purge concentration value being determined such that the magnitude of the change in fuel delivered to the cylinder due to said increment is substantially the same as the magnitude of the change in fuel delivered due to an increment of said correction factor.

13. A method for determining the concentration of fuel vapor contained in purge gas inducted into a cylinder of an internal combustion engine during purging of an evaporative emission control system, the method comprising the steps of:

(a) obtaining a data value representative of the concentration of purge fuel vapors in the purge gas, (b) operating a purge valve to permit the purge gas to be drawn into the cylinder of the internal combustion engine, (c) determining an additional amount of fuel to be injected into the cylinder using said data value, (d) injecting said additional fuel into the cylinder, (e) determining an error related to the magnitude of the difference between the total amount of fuel provided to the cylinder and a desired amount of fuel, wherein said error is determined using a measurement of exhaust gases produced by combustion of said purge fuel and said additional fuel, and (f) adjusting said data value based on said error.

14. The method of claim 13, further comprising the step of iteratively repeating steps (a), (b), (c), (d) and (e) and integrating the error over the course of a number of said iterations, wherein step (f) further comprises adjusting said data value when the integrated error exceeds a selected value.

15. The method of claim 13, wherein steps (e) and steps (f) comprise the of:

monitoring the exhaust gases produced by combustion of said purge fuel and said additional fuel using a sensor that generates a signal indicative of the air/fuel ratio of said exhaust gases, converting said signal to a feedback value, comparing said feedback value to a desired value indicative of a desired air/fuel ratio, and adjusting said data value if said feedback value is greater than or less than said desired value.

16. The method of claim 13, further comprising the step of providing a charcoal canister and a canister vent valve that is coupled to the charcoal canister to permit control of the flow of atmospheric air through the canister, wherein the charcoal canister is coupled to receive and store fuel vapors from a fuel tank that holds fuel used by the engine.

17. The method of claim 16, wherein said data value comprises a canister concentration value and wherein step (b) further comprises maintaining the canister vent valve in an open position during operation of the purge valve to thereby permit purging of the canister by drawing atmospheric air through the canister.

18. The method of claim 16, wherein said data value comprises a fuel tank concentration value and wherein step (b) further comprises maintaining the canister vent valve in a closed position during operation of the purge valve to thereby permit air and fuel vapors from the fuel tank to be drawn through the canister and into the cylinder of the internal combustion engine.

19. A method of controlling a solenoid-actuated charcoal canister purge valve to limit the portion of fuel that is supplied via the purge valve to a cylinder of an internal combustion engine, the method comprising the steps of:

determining a duty cycle for use in energizing the solenoid-actuated purge valve, said duty cycle being determined in accordance with an intake airflow and a purge factor, energizing the solenoid-actuated purge valve using the duty cycle to thereby supply a quantity of purge fuel to the cylinder, supplying an additional quantity of fuel to the cylinder, whereby the total fuel supplied to the cylinder includes said purge fuel and said additional quantity of fuel, determining a purge equivalence ratio that is related to the percentage of the total fuel that comprises purge fuel, and decreasing said purge factor if said purge equivalence ratio is greater than a selected percentage and increasing said purge factor if said purge equivalence ratio is less than a selected percentage.

20. The method of claim 19, wherein said duty cycle has a minimum value (min) and a maximum value (max) that varies in accordance with said intake airflow and wherein said duty cycle is determined using said purge factor (pf) in accordance with the following equation:

$$\text{duty cycle}=pf(max-min)+min.$$

21. The method of claim 19, wherein said purge factor has a maximum value that varies in accordance with said intake airflow.

* * * * *